United States Patent [19]

Giacomazzi et al.

[11] Patent Number: 4,673,009

[45] Date of Patent: Jun. 16, 1987

[54] FUEL TANK VENTING

[75] Inventors: Roy A. Giacomazzi, Washington Township, Macomb County; Gregory E. Rich, Richmond, both of Mich.

[73] Assignee: General Motors Corporation, Detroit, Mich.

[21] Appl. No.: 867,071

[22] Filed: May 27, 1986

[51] Int. Cl.[4] ..... B65B 3/04

[52] U.S. Cl. ..... 141/198; 141/303; 141/52

[58] Field of Search ..... 141/285–310, 141/37–66, 94–96, 192–229

[56] References Cited

U.S. PATENT DOCUMENTS 2,060,276 11/1936 Bondurant ..... 141/303

3,732,902 5/1973 Muller ..... 141/303

*Primary Examiner*—Houston S. Bell, Jr.

*Attorney, Agent, or Firm*—C. K. Veenstra

[57] ABSTRACT

A fuel tank has a filler neck terminating in an upwardly opening well, and a paddle overlying the well has a pivoted arm extending adjacent a vent valve. The arm causes the valve to restrict flow through a vent orifice when fuel is not being introduced through the filler neck, but pivots to allow the valve to open the orifice in response to introduction of liquid fuel through the filler neck. A float has an actuating member adapted to cause the valve to restrict flow through the orifice when the level of liquid fuel in the tank approaches the maximum level desired.

2 Claims, 2 Drawing Figures

FUEL TANK VENTING

TECHNICAL FIELD

This invention relates to control of vapor released during filling of a fuel tank.

SUMMARY OF THE INVENTION

When filling an automotive fuel tank, the fuel vapor in the space above the rising liquid level is displaced out of the tank. To avoid releasing the fuel vapor to the atmosphere, earlier proposals have vented the vapor to a vapor storage canister.

This invention provides a fuel tank vent actuator that opens a vent to allow unrestricted flow of fuel vapor to a vapor storage canister during filling of the tank, and that restricts the vent to inhibit flow of fuel vapor to the canister at other times.

The details as well as other features and advantages of a preferred embodiment of this invention are set forth in the remainder of the specification and are shown in the drawing.

THE PREFERRED EMBODIMENT

Figure 1:
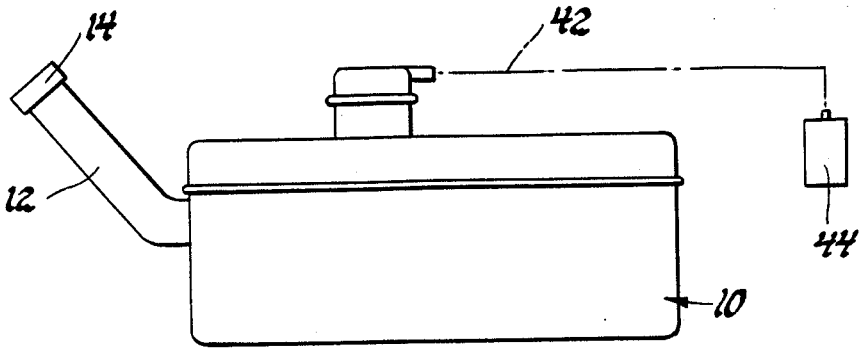
FIG. 1 is a schematic view of an automotive fuel tank venting system employing this invention.
Figure 2:
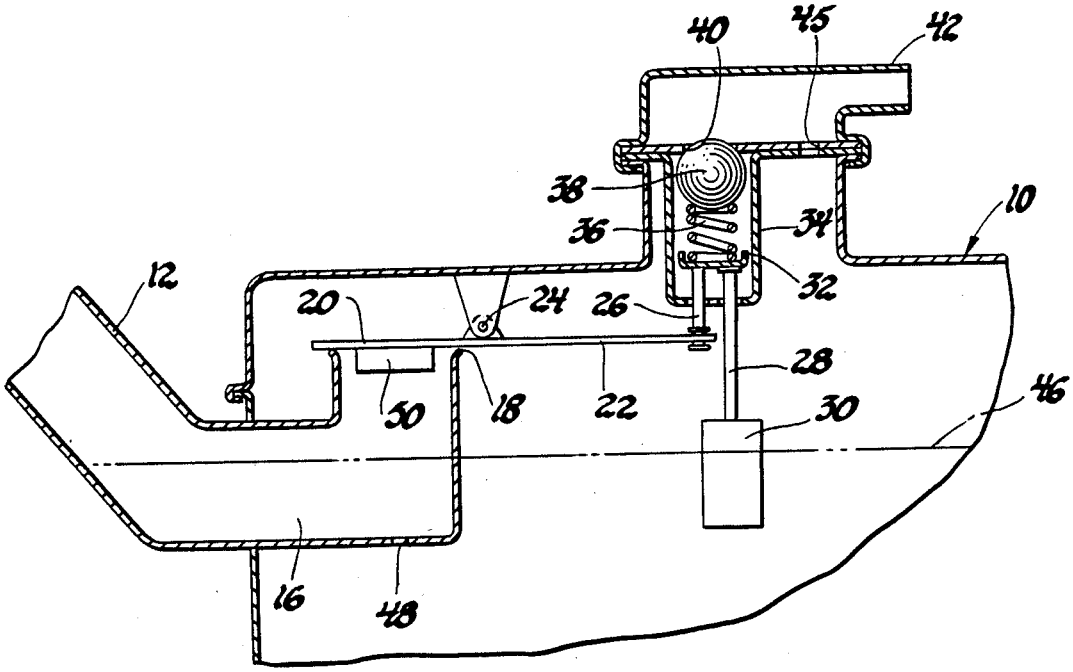
FIG. 2 is an enlarged schematic view of a portion of the FIG. 1 system showing details of the vent actuator.

Referring to the drawing, a fuel tank 10 has a filler neck 12 through which fuel is introduced to the tank. Filler neck 12 is normally closed by a filler cap 14.

With cap 14 removed, fuel introduced through filler neck 12 fills a well 16 at the bottom of the filler neck, then spills over the top 18 of well 16 into the main portion of the tank. The fuel in well 16 forms a liquid seal that prevents the fuel vapor in the top of tank 10 from flowing out through filler neck 12.

A paddle 20 overlies the top 18 of well 16 and forms one end of an arm 22 pivoted at 24. The other end of arm 22 terminates in an actuating rod 26. Actuating rod 26 acts in parallel with an actuating rod 28 supported by a float 30. When lifted by arm 22 and float 30, actuating rods 26 and 28 engage a spring seat 32. Seat 32 rides in a cage 34 and, when engaged either by rod 26 or rod 28, compresses a spring 36 to engage a ball valve 38 across a vent orifice 40.

As the level of fuel in tank 10 drops, float 30 retracts actuating rod 28 from seat 32. As fuel is introduced through filler neck 12 and spills over the top 18 of well 16, the fuel impacts and lifts paddle 20, and paddle 20 pivots arm 22 about pivot 24 to retract actuating rod 26 from seat 32. Valve ball 38 accordingly moves away from orifice 40 to allow fuel vapor to flow from tank 10 through orifice 40 and a vent line 42 to a fuel vapor storage canister 44.

When the level of fuel in tank 10 approaches the maximum level 46 desired, float 30 lifts rod 28 to engage spring seat 32, compressing spring 36 to engage ball valve 38 across vent orifice 40. With valve ball 38 engaged across orifice 40, the fuel vapor displaced from tank 10 must flow through a restricted vent orifice 45 and vent line 42 to canister 44. Orifice 45 cannot pass fuel vapor at the rate at which fuel is introduced through filler neck 12, and the fuel vapor accordingly is compressed in the top of tank 10. The resulting increase in pressure in tank 10 causes the liquid fuel level to rise in filler neck 12 and thereby signal that the tank is full. The liquid fuel in filler neck 12 then slowly drains from well 16 into the main portion of tank 10 through a small orifice 48.

Paddle 20 may be provided with a float 50 to assist in lifting paddle 20 as fuel is introduced through filler neck 12. Float 50 may further serve as, or be replaced by, a counterweight to assure that paddle 20 returns to the position shown when fuel is not being introduced through filler neck 12. In the position shown, paddle 20 and its arm 22 lift actuating rod 26 to engage spring seat 32, compressing spring 36 to engage ball valve 38 across vent orifice 40. With ball valve 38 engaged across orifice 40, fuel vapor may flow from tank 10 only through restricted vent orifice 45 and vent line 42 to canister 44.

The embodiments of the invention in which an exclusive property or privilege is claimed are defined as follows:

1. In a fuel tank having a filler neck for introducing fuel to the tank, a vent orifice, and a vent valve controlling flow through said orifice: a vent actuator comprising means adapted in the absence of introduction of fuel through said filler neck for engaging said vent valve across said orifice to restrict flow therethrough, said vent actuator being responsive to the introduction of fuel through said filler neck for allowing said vent valve to permit flow through said orifice, and float means for causing said vent valve to restrict flow through said orifice when the level of liquid fuel in said tank approaches the maximum level desired.

2. In a fuel tank having a vent orifice, a valve controlling flow through said vent orifice, and a filler neck terminating within the tank in an upwardly opening well, a vent actuator comprising a paddle overlying said well and having a pivoted arm extending adjacent said valve, said arm including an actuating member adapted to cause said valve to restrict flow through said orifice when fuel is not being introduced through said filler neck, said paddle and said arm pivoting to allow said valve to permit unrestricted flow through said orifice in response to introduction of liquid fuel through said filler neck, and a float having an actuating member adapted to cause said valve to restrict flow through said orifice when the level of liquid fuel in said tank approaches the maximum level desired.

* * * * *